US005842876A

United States Patent [19]

Collin et al.

[11] Patent Number: 5,842,876

[45] Date of Patent: Dec. 1, 1998

[54] POWER CLIP FOR PRINTED CIRCUIT

[75] Inventors: Edwin J. Collin, Southington; Carmine Gugliotti, Waterbury, both of Conn.

[73] Assignee: Litton Systems, Inc., Watertown, Conn.

[21] Appl. No.: 904,521

[22] Filed: Aug. 1, 1997

[51] Int. Cl.[6] ..... H01R 9/09

[52] U.S. Cl. ..... 439/78; 439/947

[58] Field of Search ..... 439/78, 637, 856, 439/857, 947, 82, 63

[56] References Cited

U.S. PATENT DOCUMENTS

| | | | |
|---|---|---|---|
| 4,017,143 | 4/1977 | Knowles | 439/637 |
| 4,166,667 | 9/1979 | Griffin | 439/637 |
| 4,191,440 | 3/1980 | Schramm | 439/751 |
| 4,269,468 | 5/1981 | Ammon et al. | 439/637 |
| 4,762,500 | 8/1988 | Dola et al. | 439/947 |
| 4,790,764 | 12/1988 | Kawaguchi et al. | 439/78 |

*Primary Examiner*—Steven L. Stephan
*Assistant Examiner*—T C Patel

[57] ABSTRACT

A power clip for a printed circuit board. The power clip comprises a substantially planar base having an electrical contact extending therefrom, especially in the form of a spring clip. The base of the power clip has stand-offs at opposed ends and a raised platform extending downwardly to contact the surface of the printed circuit board. The base has a plurality of electrical contact pins in a grid pattern. The pins are adapted for insertion into plated through holes in a printed circuit board.

10 Claims, 3 Drawing Sheets

POWER CLIP FOR PRINTED CIRCUIT

FIELD OF THE INVENTION

The present invention relates to a power clip for a printed circuit board, and especially to a power clip providing electrical contact between a power supply blade and the printed circuit board. The power clip is adapted to be removably inserted into the printed circuit board, and to make electrical contact with conductive paths on the printed circuit board without requiring the use of solder.

BACKGROUND OF THE INVENTION

In printed circuit board applications, it is necessary to provide a source of electricity to the printed circuit board, and frequently necessary or desirable to be able to couple a power supply directly into the circuit board. It is preferred to be able to couple a single power supply to a plurality of circuits within the circuit board, without causing overheating or other problems.

One example of an electrical connector for coupling power cables or leads to circuit boards is disclosed in U.S. Pat. No. 4,191,440, which discloses an electrical connector having a threaded aperture onto which the power lead is connected. Connection to the circuit board is accomplished by a plurality of pin contacts that are inserted into corresponding apertures (plated through holes) in the printed circuit board. A projecting stud-like member on the connector is intended to counteract shear stresses between the connector and the circuit board, such stresses being exerted on the pins in the absence of the stud-like member.

Electrical contacts that may be inserted into a plated through hole within an insulated mounting board e.g. a printed circuit board, for making electrical contact with conductive paths thereon without requiring solder is disclosed in U.S. Pat. No. 4,017,143. That patent discloses an electrical contact with a C-shaped cross section that reduces internal stress on insertion into a plated through hole.

Solder-less electrical contacts have been secured within apertures, referred to herein as plated through holes, in printed circuit boards by using the concept of a square pin in a round hole. This configuration has the disadvantage of mechanically deforming the shape of the plated through hole upon insertion of the pin into the plated through hole, thus making removal and repeated insertion of pins into plated through holes in the printed circuit board impractical. The square pin configuration also produces an inferior electrical connection between the pin and the edges of the plated through hole viz. with the internal circuit of the printed circuit board, due to the effects of corrosion from circulation of the ambient atmosphere over a period of time.

SUMMARY OF THE INVENTION

A power clip for a printed circuit board or related insulated mounting board having a plurality of electrical contacts has now been found.

Accordingly, an aspect of the present invention provides a power clip for a printed circuit board comprising:

a substantially planar base having a first surface and a second surface, preferably an elongated substantially planar base or a square substantially planar base, said first surface having an electrical contact extending therefrom, said electrical contact having opposed extended arms biased into mutual contact, said second surface having stand-offs at opposed ends and a raised platform opposed to said electrical contact, said second surface having a grid of possible electrical contact positions between said raised platform and each of said stand-offs, at least some of said possible electrical contact positions having an electrical contact pin extending therefrom, each electrical contact pin being adapted for insertion into plated through holes in a printed circuit board.

In a preferred embodiment of the present invention, the electrical contact pins are C-shaped electrical contact pins.

In another embodiment of the present invention, the stand-offs and the raised platform have surfaces that are in a plane.

BRIEF DESCRIPTION OF THE DRAWINGS

The present invention is illustrated by the embodiments shown in the drawings in which.

DETAILED DESCRIPTION OF THE INVENTION

Figure 1:
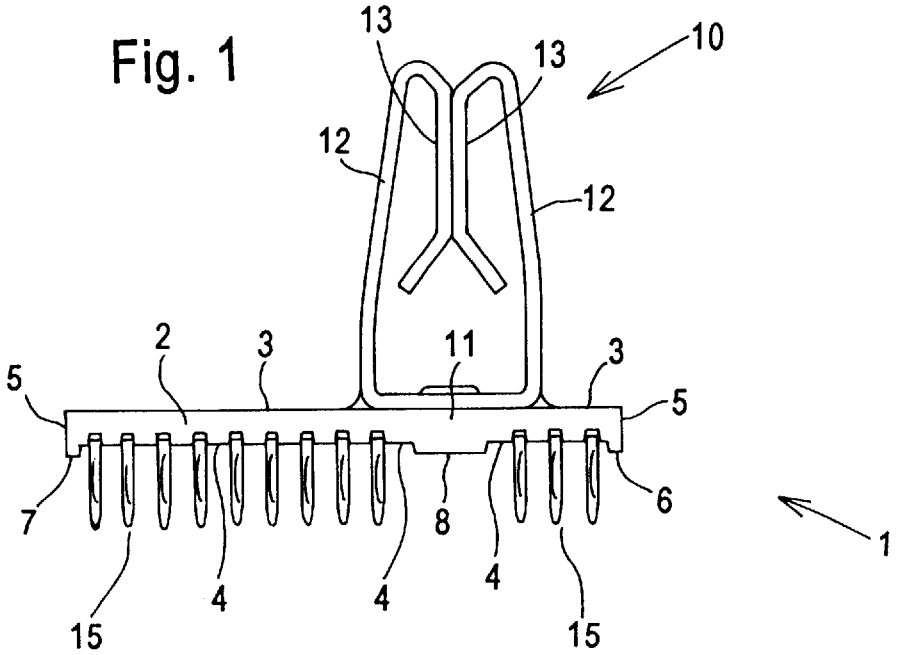
FIG. 1 is a schematic representation of a side view of the power clip of the present invention.

FIG. 1 shows a power clip, generally indicated by 1. Power clip 1 has an electrically conductive base 2 with an upper surface 3, a lower surface 4 and opposed base ends 5. Each of base ends 5 has a stand-off, 6 and 7, extending downwards from lower surface 4. In addition, lower surface 4 has a raised platform 8 extending downwards from lower surface 4. As discussed below, stand-offs 6 and 7 and raised platform 8 preferably extend downwards by the same amount i.e. so that the surfaces of each of stand-offs 6 and 7 and raised platform 8 are in a plane.

Base 2 is shown in the embodiments illustrated in the drawings as being an elongated substantially planar base. However, it is to be understood that other shapes of base 2 may be used e.g. base 2 may be a square or other shaped base. Base 2 is made of an electrically conductive material.

Upper surface 3 of power clip 1 has contact clip 10 thereon. Contact clip 10 is attached to base 2 by clip attachment 11, which is located opposed to raised platform 8, as discussed below, especially with respect to FIG. 6. Contact clip 10 is a unitary clip having opposed clip arms 12, each of which extends upwards from upper surface 3 and then is curved inwards to form clip arm contacts 13. Opposed clip arm contacts 13 are in physical (mechanical) contact with each other, being urged inwardly i.e. biased inwardly, by clip arms 12, thereby forming a spring-like contact clip. Clip arm contacts 13 are normally in physical contact, but may be separated for insertion of a power blade, as described below.

Lower surface 4 of base 2 has a plurality of electrical contact pins 15, which may also be referred to as electrical terminals, extending downwardly therefrom. Pins 15 are shown as being located on both sides of raised platform 8, and are shown as being symmetrically spaced apart. The arrangement of the pins, which is in a grid pattern, is discussed further below.

Figure 2:
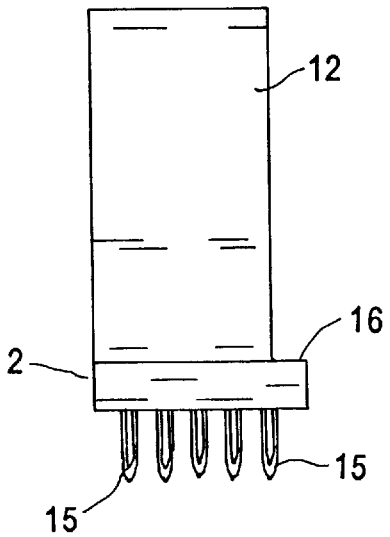
FIG. 2 is a schematic representation of an end view of the power clip.

FIG. 2 shows an end view of power clip 1, with clip arm 12 extending upwardly from base 2 and pins 15 extending downwardly therefrom. Pins 15 are uniformly spaced apart, being in a grid pattern as discussed below, and uniformly spaced from the respective edges of base 2. In the embodiment shown in FIG. 2, clip arm 12 is shown as being located off-centre, with one edge of clip arm 12 being aligned with the respective edge of base 2; however, it is to be understood that it is not necessary that clip arm 12 be located off-centre. As is illustrated, an off-centre location of clip arm 12 forms ledge 16 on base 2 on the opposed side of base 2.

In an embodiment of the invention, pins 15 are C-shaped pins, especially C-shaped pins as discussed in U.S. Pat. No. 4,017,143, e.g. FIGS. 2 and 5 thereof, such patent being incorporated herein by reference. The pins of this embodiment have a C-shaped cross-section, which has resiliency and permits the diameter of the pin to yield as it is inserted into an plated through hole of a printed circuit board. Such resiliency tends to reduce physical damage to the plated through hole, facilitating removal and reinsertion of a power clip into the plated through hole of the printed circuit board, as well as reducing the potential adverse effect of circulation of the ambient atmosphere around the pin within the plated through hole. However, it will be understood that in other embodiments other compliant pin shapes may be used.

Figure 3:
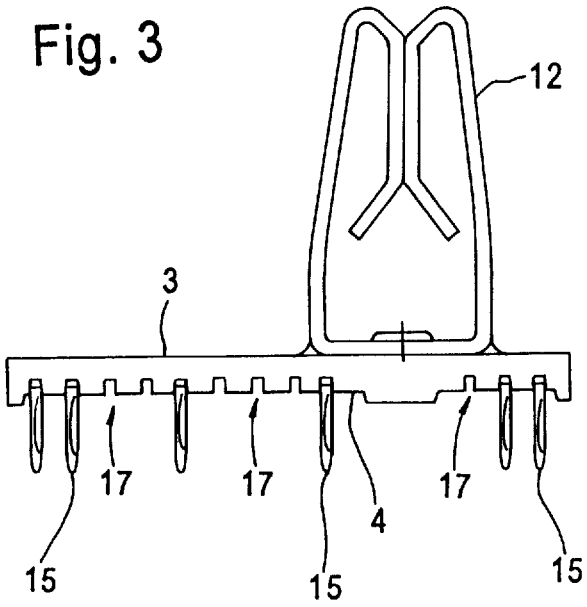
FIG. 3 is a schematic representation of another embodiment of the power clip of the present invention.

FIG. 3 shows an alternate embodiment of the power clip of FIG. 1. In the embodiment of FIG. 3, a number of pins 15 have been omitted from the lower surface 4 of base 2 of power clip 1. The omission of pins 15 leaves possible contact positions 17 located at the positions previously occupied by pins 15. The embodiment of FIG. 1 has a grid of pins 15, as shown in more detail below, whereas the embodiment of FIG. 3 has pins 15 at selected locations in the grid of possible pin placements i.e. the grid consists of pins 15 and possible contact positions 17, with the arrangement of pins being dictated by the amperage requirements of the particular circuit board.

Figure 6:
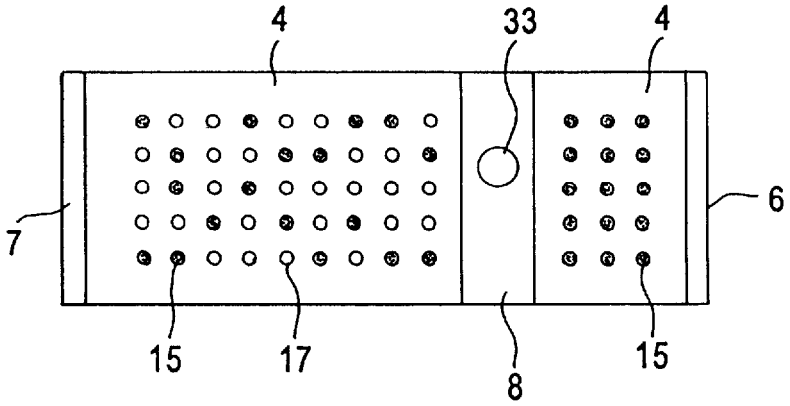
FIG. 6 is a schematic representation of an embodiment of the power clip, viewed from beneath the power clip.

FIG. 3, and FIG. 6 discussed below, shows only some pins in each of the rows across the width of the grid. However, it is preferred, including for ease of manufacture, for the rows across the width of the grid to either have a full set of pins or the complete absence of any pins. Any combination of rows with and without pins may be used in the power clip, in order to meet amperage requirements of the printed circuit board e.g. the current carrying capability of the board. Thus, the power clip of the present invention may have a variety of patterns of pins in the grid.

Figure 4:
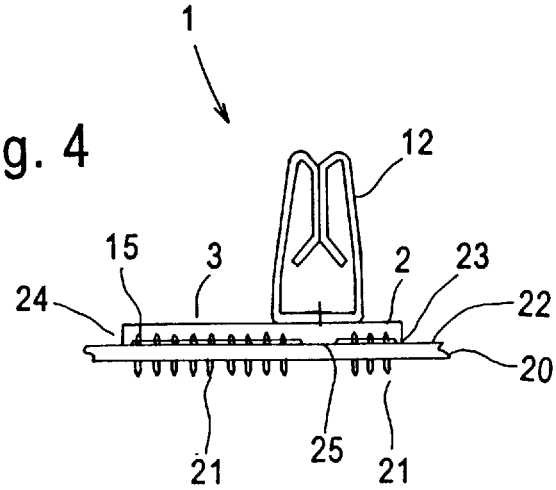
FIG. 4 is a schematic representation of the power clip of FIG. 1 in a printed circuit board.

FIG. 4 shows power clip 1 located in printed circuit board 20. Pins 15 of power clip 1 extend through plated through holes (not shown) in printed circuit board 20, with pin ends 21 extending beneath printed circuit board 20. It is understood that pins 15 would normally be connected to circuits within the printed circuit board 20.

Base 2 of power clip 1 is in physical contact with upper surface, 22, of printed circuit board 20. Physical contact between base 2 and surface 22 of printed circuit board 20 is made at the stand-offs (6 and 7 of FIG. 2) and raised platform (8 in FIG. 1) extending downward from the lower surface of base 2 of the power clip. Thus, base 2 contacts the upper surface 22 of the printed circuit board at stand-off contacts 23 and 24 and platform contacts 25.

Figure 5:
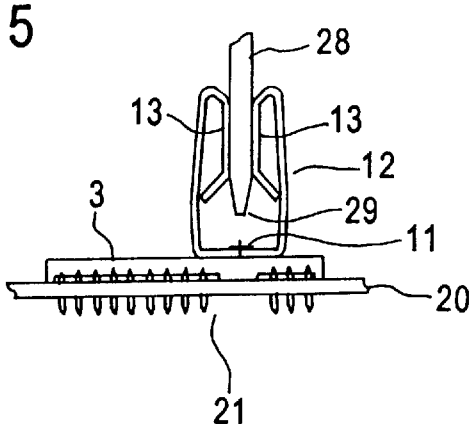
FIG. 5 is a schematic representation of the power clip in a printed circuit board with power supply blade.

FIG. 5 shows the embodiment of FIG. 4, in which power supply blade 28 has been inserted in contact clip 10, between clip arm contacts 13 of the respective clip arms 12. Power supply blade 28 is located on the end of a power supply lead. Blade tip 29 passes through clip arm contacts 13.

FIG. 6 shows the underside of a power clip, with pins 15 and possible contact positions 17. It will be noted that the combination of pins 15 and possible contact positions 17 forms a grid pattern, one part of the grid pattern being on one side of raised platform 8 and the other part of the grid pattern being on the opposed side of raised platform 8. The grid pattern extends between raised platform 8 and either stand-off 6 or stand-off 7. In the embodiment shown, the grid pattern shows a 5×9 grid pattern of pins 15 and possible contact positions 17 on one side of raised platform 8 and a 5×3 grid pattern of pins 15 and possible contact positions 17 on the other side of raised platform 8, but it is to be understood that any convenient grid pattern may be used. In the embodiment shown in FIG. 6, the larger part of the grid pattern is shown as having a random location of pins 15, which is one embodiment of the invention in which pins 15 are located as required to meet amperage requirements. The smaller part of the grid pattern is shown as having pins 15 in all locations, which is an alternate embodiment. Such grid patterns have been discussed above. It will be apparent that the grid pattern of possible contact positions may be fully populated with electrical contact pins, or not fully populated.

Raised platform 8 is shown as having recessed rivet 33 thereon, which is the opposed end of clip attachment 11 shown previously. The rivet is recessed so that raised platform 8 may contact the upper surface of a printed circuit board in the same plane as stand-offs 6 and 7.

The arrangement of terminals or pins at the base of the power clip can be varied to accommodate different plated through hole configurations in the printed circuit board. Multiple parallel circuits on the printed circuit board may be connected to the power clip so as to meet power requirements of the printed circuit board at a reduced risk of overload of any one circuit on the printed circuit board. This permits the printed circuit board to be used for high-current applications, while reducing the potential for damaging of circuits on the printed circuit board due to overload situations. In addition to the advantages relating to high-current overload situations, the grid of pins permits the mechanical load to be distributed over a greater surface area of the printed circuit board, so as to minimize the potential for physical damage to the printed circuit board from insertion into the power clip and removal of the power blade from the power clip.

In addition, the two stand-offs and the raised platform on the base of the power clip provide a fixed and automatic seating of the power clip on a printed circuit board, further reducing the likelihood of damage to the printed circuit board. The spaces created by the raised stand-offs guarantees access to the area between the power clip and printed circuit board, around the pins, for cleaning of the board as well as access for a removal tool in the case of the need for replacement of the power clip. This reduces damage to the plated through holes in the printed circuit board due to the upward movement of the pins of the power clip, e.g. upward movement of the C-shaped electrical contact pins during removal.

In an example of a power clip of the present invention, the pins in the grid are arranged on a 2.5 mm grid spacing, which yields a compact high-current connector. In such an embodiment, the power clip may measure approximately 39×15 mm.

The power clip of the present invention allows flexibility due to the transverse arrangement of the contact strips, which allows variability of current rating by varying the quantity of the same contact parts.

The power clip provides electrical contacts for plug-in board applications where power can be transferred, for instance, through a contact blade into busswork, motherboards or the like without the need to fix fasteners, cables or busswork into the clip. This permits flexibility in the design of equipment, as physical access to clips and/or contact blades is not required for mechanical and electrical integrity. Such integrity is provided by the mating of the clip into the printed circuit board.

The surface area and the attachment of the clip arms to the base, optionally with the use of solder, of the power clip of the invention provide a surface area with a recommended blade so that low temperature rise and contact resistance can be expected.

We claim:

1. A power clip usable with a printed circuit board comprising:

a substantially planar base having a first surface and a second surface:

an electrical contact extending from said first surface, said electrical contact having opposed extended arms biased into mutual contact for connection to a source of electrical power, said second surface having a grid of possible electrical contact positions, each of said electrical contact positions being electrically connected to said electrical contact at least one electrical contact pin inserted into a corresponding electrical contact position extending from at least one of said possible electrical contact positions, each electrical contact pin being insertable into corresponding plated through holes in the printed circuit board.

2. The power clip of claim 1, wherein said second surface has stand-offs at opposed ends thereof and a raised platform opposite said electrical contact.

3. The power clip of claim 2 in which the stand-offs and the raised platform have surfaces that are in a plane.

4. The power clip of claim 3 in which the base is an elongated substantially planar base.

5. The power clip of claim 3 in which at least one row of possible electrical contact positions extending across said power clip do not have electrical contact pins extending therefrom.

6. The power clip of claim 3 in which possible electrical contact positions of the electrical grid are fully populated with electrical contact pins.

7. The power clip of claim 3 in which possible contact positions of the electrical grid are not fully populated with electrical contact pins.

8. The power clip of claim 3 in which the electrical contact is a spring clip.

9. The power clip of claim 3 in which the electrical contact pins are C-shaped electrical contact pins.

10. The power clip of claim 1, wherein said base is electrically conductive.

* * * * *